US008631960B2

(12) United States Patent
Schütz

(10) Patent No.: US 8,631,960 B2
(45) Date of Patent: Jan. 21, 2014

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 12/380,284

(22) Filed: Feb. 25, 2009

(65) Prior Publication Data

US 2009/0230017 A1 Sep. 17, 2009

(30) Foreign Application Priority Data

Feb. 27, 2008 (DE) ..... 10 2008 011 423

(51) Int. Cl.
*B65D 25/14* (2006.01)

(52) U.S. Cl.
USPC ..... 220/495.01; 206/386

(58) Field of Classification Search
USPC ..... 206/599, 386; 220/1.6, 23.9, 495.06, 220/592.21, 4.12, 3.4, 485, 495.01; 108/55.1, 57.25
See application file for complete search history.

(56) References Cited

U.S. PATENT DOCUMENTS

| | | | | | |
|---|---|---|---|---|---|
| 2,371,106 | A * | 3/1945 | Lewis et al. | ..... | 108/57.1 |
| 2,639,112 | A * | 5/1953 | Cushman | ..... | 108/56.3 |
| 2,997,266 | A * | 8/1961 | Munroe | ..... | 108/51.3 |
| 3,294,306 | A * | 12/1966 | Areddy | ..... | 206/596 |
| 4,676,363 | A | 6/1987 | Buchmüller et al. | | |
| 4,676,373 | A * | 6/1987 | Schneider | ..... | 206/386 |
| 4,795,057 | A * | 1/1989 | Jungels et al. | ..... | 206/386 |
| 4,863,024 | A * | 9/1989 | Booth | ..... | 206/386 |
| 5,058,747 | A * | 10/1991 | Decroix et al. | ..... | 206/599 |
| 5,111,937 | A * | 5/1992 | Schutz | ..... | 206/386 |
| 5,447,250 | A * | 9/1995 | Schutz | ..... | 220/62.11 |
| 6,454,113 | B1 * | 9/2002 | Schutz | ..... | 220/1.6 |
| 6,622,642 | B2 * | 9/2003 | Ohanesian | ..... | 108/57.25 |
| 6,719,162 | B2 * | 4/2004 | Przytulla | ..... | 220/23.91 |
| 6,832,693 | B2 * | 12/2004 | Schutz | ..... | 220/495.01 |
| 7,107,912 | B2 * | 9/2006 | Schutz | ..... | 108/55.1 |
| 7,556,720 | B2 * | 7/2009 | Cassina | ..... | 204/192.14 |

FOREIGN PATENT DOCUMENTS

DE 101 10 926 9/2002

* cited by examiner

*Primary Examiner* — Steven A. Reynolds
*Assistant Examiner* — Ernesto Grano
(74) *Attorney, Agent, or Firm* — McGlew and Tuttle, P.C.

(57) ABSTRACT

A transport and storage container for liquids, which can be used as a single-use or multiple-use container, has as its principal components an exchangeable parallelepiped-shaped inner container of plastic material with a front wall, a rear wall and two side walls, a lower and an upper bottom, a filling socket integrally formed on the upper bottom and closable by means of a cover, and a discharge socket to be connected to a discharge fitting, wherein the discharge socket is integrally formed or welded to an indentation in the lower portion of the front wall. The container further includes an outer casing constructed as a grate casing with intersecting horizontal and vertical grate rods of metal for receiving the inner container, and an underframe constructed as a pallet with skids.

7 Claims, 5 Drawing Sheets

TRANSPORT AND STORAGE CONTAINER FOR LIQUIDS

BACKGROUND OF THE INVENTION

1. Field of the Invention

The present invention relates to a transport and storage container for liquids. The container includes an inner container of plastic material with a closable filling socket and a draining socket for connection to a removal fitting, an outer casing of metal mesh or sheet metal and an underframe constructed as a skid pallet which is configured to be manipulated by a lifting truck, a shelf operating device, or similar transport device, and with a bottom resting with support legs on a middle skid and on two outer skids for supporting the inner container, wherein the lower bottom has a discharge groove at a middle of the bottom, wherein the discharge groove extends with a slight incline from the rear wall of the container to the discharge socket arranged at a front wall of the container and adapted for connection to the discharge fitting.

2. Description of the Related Art

A transport and storage container for liquids of the type described above is equipped with an underframe which is constructed as a pallet with skids which include a center skid and two outer skids of plastic material and a bottom of sheet metal resting on the support legs of the skids, wherein the inner container of plastic material of the transport container for receiving liquids is placed on the bottom of sheet metal.

Offered on the market are also transport containers for liquids which are equipped with a pallet of wood for supporting the inner container which is enclosed by a casing of sheet metal or a grate.

The manufacturing costs of the pallet with skids consisting of a bottom of sheet metal and skids of plastic materials are relatively high and the pallet of wood becomes increasingly expensive because of the increasing price of wood.

SUMMARY OF THE INVENTION

It is the object of the present invention to provide a transport and storage container for liquids of the above-described type which is further developed in order to reduce the costs of the manufacture of the underframe.

In accordance with the present invention, the skid pallet of the underframe of the transport and storage container is constructed as a composite pallet with a flat bottom made of wood boards and a metal skid and two outer skids of plastic material each with a front support leg, a center support leg, and a rear support leg.

The skid pallet of the underframe of the transport and storage container for liquids constructed as a composite pallet of three plastic skids and a flat bottom of wood boards makes it possible to reduce the manufacturing costs as compared to liquid containers of the above-described kind which are offered in the market place.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
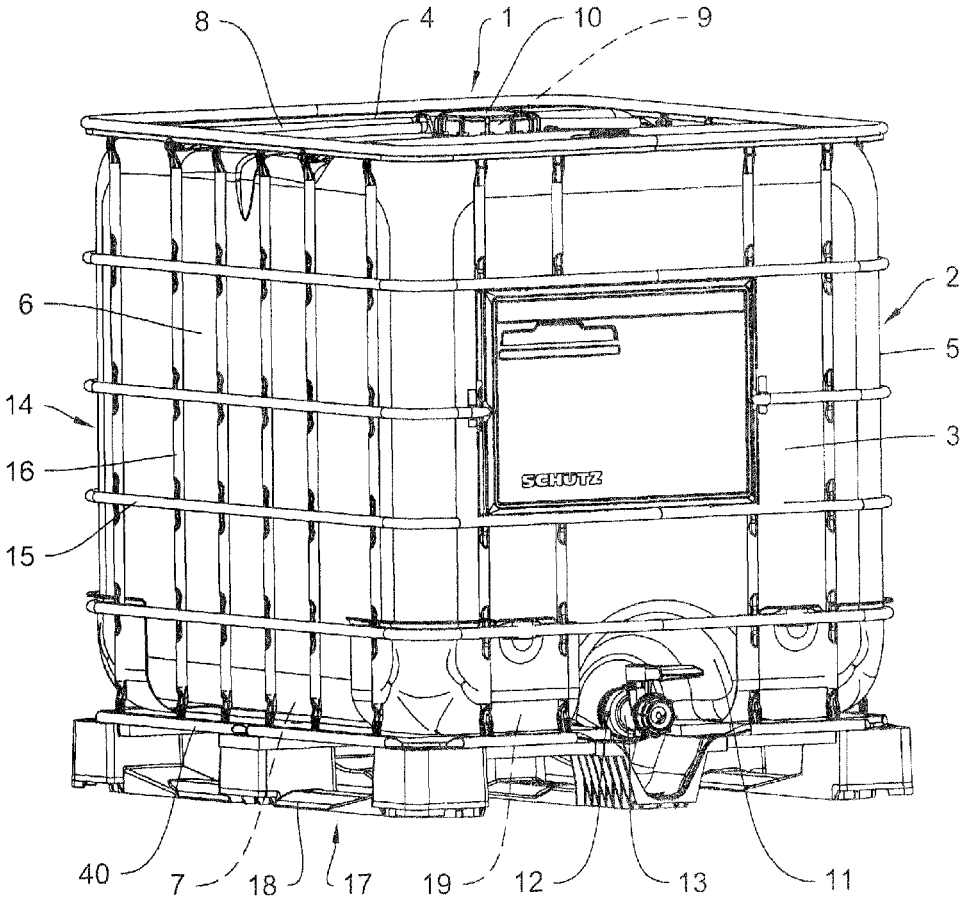
FIG. 1 is a perspective view of a transport and storage container for liquids with an underframe constructed as a pallet with skids.
Figure 2:
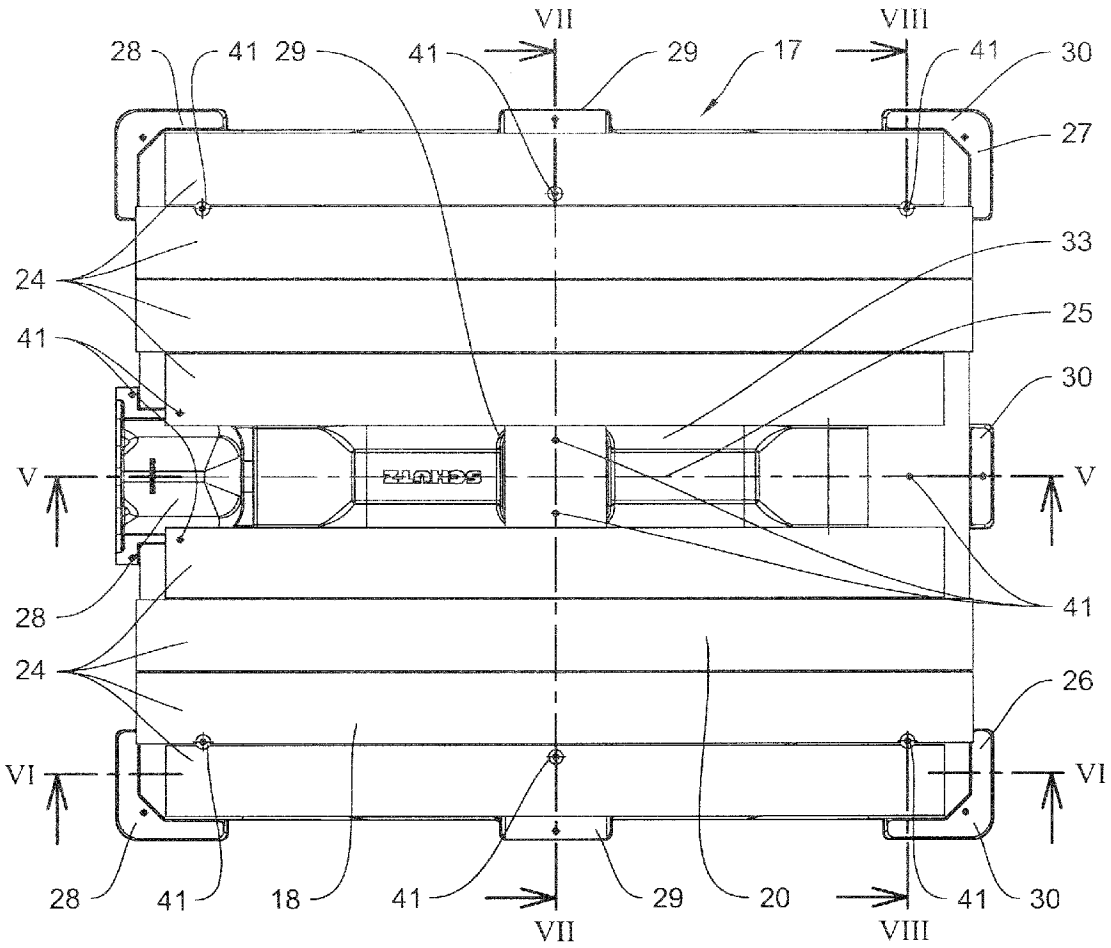
FIG. 2 is a top view of the skid pallet of the underframe.
Figure 3:
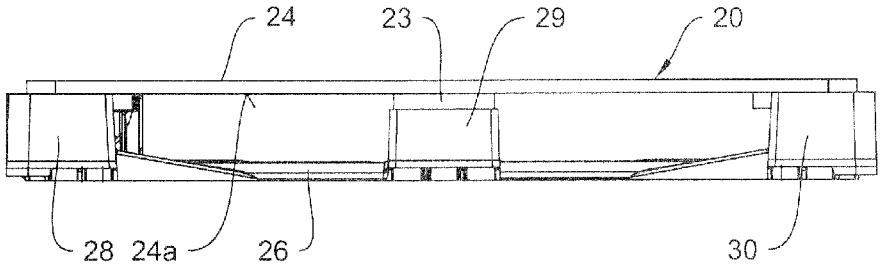
FIG. 3 is a side view of the underframe.
Figure 5:
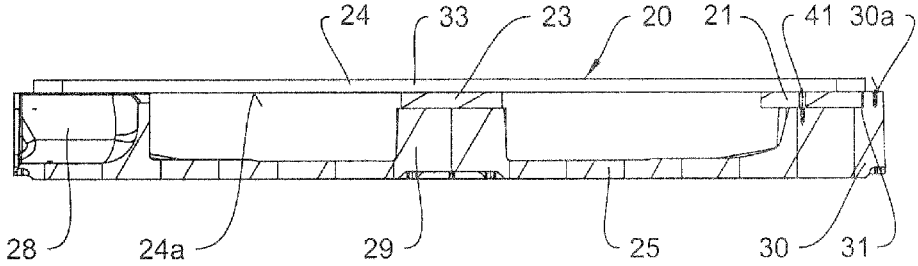
FIGS. 5 and 6 are longitudinal sectional views of the skid pallet taken along sectional lines V-V and VI-VI of FIG. 2, respectively.
Figure 6:
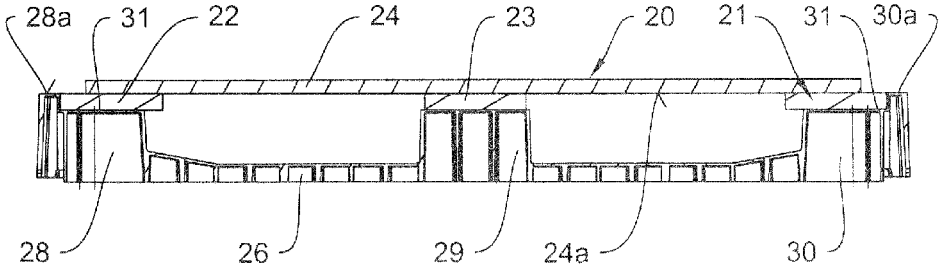

The transport and storage container 1 for liquids according to FIG. 1 which can be used as a single-use or multiple-use container has as its principal components an exchangeable parallelepiped-shaped inner container 2 of plastic material with a front wall 3, a rear wall 4 and two side walls 5, 6, a lower and an upper bottom 7 and 8, a filling socket 9 integrally formed on the upper bottom 8 and closable by means of a cover 10, and a discharge socket 12 to be connected to a discharge fitting 13, wherein the discharge socket 12 is integrally formed with or welded to an indentation 11 in the lower portion of the front wall 3. The container further includes an outer casing 14 constructed as a grate casing with intersecting horizontal and vertical grate rods 15, 16 of metal for receiving the inner container 2, and an underframe 17 constructed as a pallet 18 with skids having length and width dimensions in accordance with European standards.

The lower bottom 7 of the inner container 2 has a flat middle discharge groove 19 which extends with a slight incline from the rear wall 4 of the container to the outlet socket 12 intended for connection to the discharge fitting 13, wherein the discharge socket 12 is arranged at the front wall 3 of the container.

The pallet constructed as a composite pallet 18 of the transport container 1 is composed of a flat bottom 20 for supporting the inner container 2, wherein the flat bottom 20 is assembled from transverse boards and longitudinal boards 21-24 of wood for supporting the inner container 2, as well as a center skid 25 and two outer skids 26, 27 of plastic materials each having a front support leg 28, a center support leg 29, and a rear support leg 30 for supporting the flat bottom 20, wherein the gripping arms of a lifting device, shelf operating device or similar transport device can be moved underneath the flat bottom 20. The transverse boards 21-23 are arranged at the bottom side 24*a* of the longitudinal boards 24 of the flat bottom 20.

Figure 8:
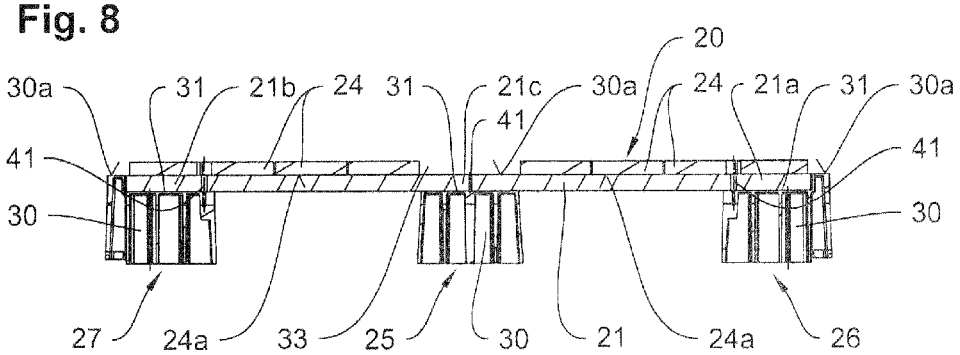

The rear transverse board 21 of the flat bottom 20 is placed with its two end portions 21*a*, 21*b* in indentations 31 in the upper side 30*a* of the rear support legs 30 of the two outer skids 26, 27, and with its middle section 21*c* in an indentation 31 at the upper side 30*a* of the rear support leg 30 of the metal skid 25, as illustrated in FIG. 8.

Figure 4:
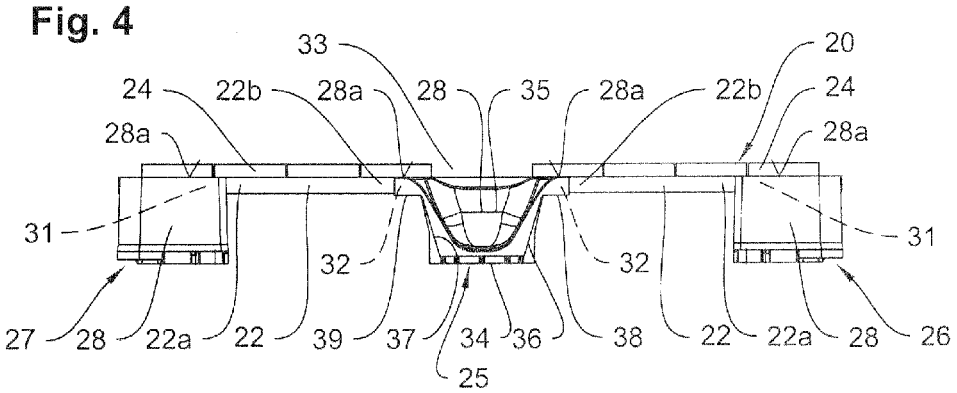
FIG. 4 is a front view of the pallet.
Figure 7:
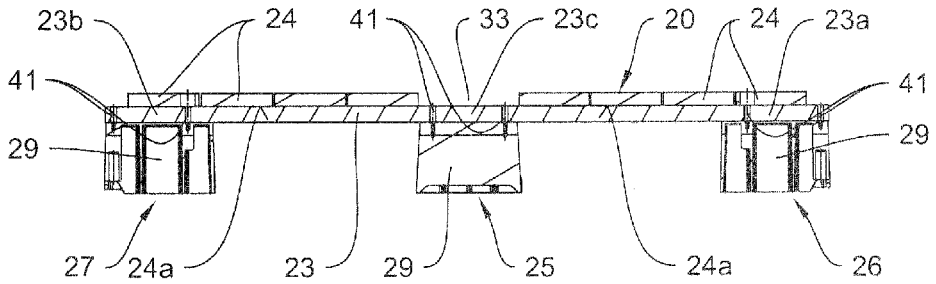
FIGS. 7 and 8 are cross-sectional views of the pallet taken along sectional lines VII-VII and VIII-VIII of FIG. 2.

Two front transverse boards 22 of the flat bottom 20 are placed with their two end sections 22*a*, 22*b* in an indentation 31 in the upper side 28*a* of the front support leg 28 of each outer skid 26, 27, and an indentation 32 in the upper side 28*a* of the front support leg 28 of the middle skid 25, as seen in FIG. 4

The center transverse board 23 of the flat bottom 20 rests with its two end sections 23*a*, 23*b* on the center support legs 29 of the two outer skids 26, 27 with its center section 23*c* on the middle support leg 29 of the center skid 25.

The flat bottom 20 is screwed 41 to the support legs 28-30 of the center skid 25 and the two outer skids 26, 27 of the skid pallet 18.

Figure 9:
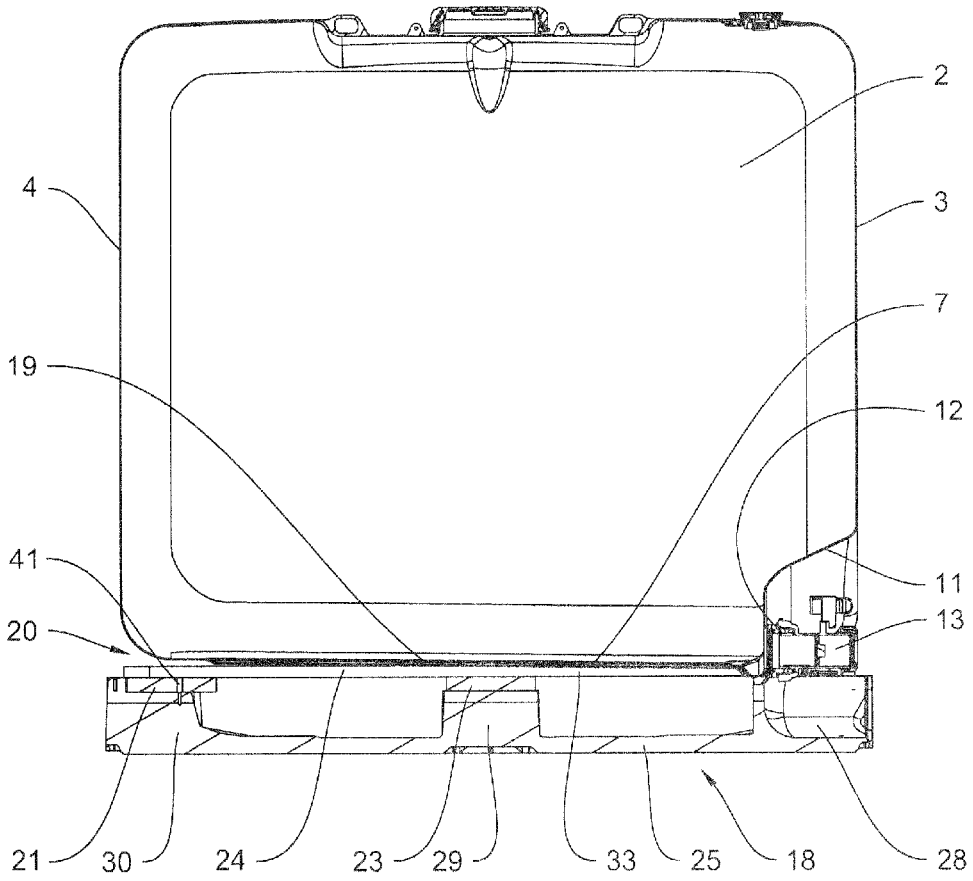
FIG. 9 is a center-longitudinal sectional view of the transport and storage container without grate casing.

The flat bottom 20 of the skid pallet 18 has above the center skid 25 a center longitudinal opening 33 for receiving the discharge groove 19 of the lower bottom 7 of the inner container 2 and the vessel-like front support leg 28 of the center skid 25, which is formed by a bottom 34, a rear wall 35 and two side walls 36, 37 with angled upper wall sections 38, 39 with the indentations 32 for inserting the end sections 22*b* of the two front transverse boards 20, receive the lower section of the housing of the draining fitting 13, as seen in FIGS. 4 and 9.

The underframe 40 of the grate casing 14 is screwed to the front and rear support legs 28, 30 of the skid 25 and the three support legs 28-30 of the two outer skids 26, 27 of the pallet 18.

While specific embodiments of the invention have been shown and described in detail to illustrate the inventive principles, it will be understood that the invention may be embodied otherwise without departing from such principles.

I claim:

1. A transport and storage container for liquids comprises an inner container of plastic material with a closable filling socket and a draining socket for connection to a removal fitting, an outer casing of metal mesh or sheet metal and an underframe constructed as a skid pallet which is configured to be manipulated by a lifting truck, a shelf operating device, or similar transport device, the skid pallet having a bottom resting with support legs on a center skid and on two outer skids for supporting the inner container, wherein a bottom of the inner container has a centrally arranged discharge groove, wherein the discharge groove extends with a slight incline from a rear wall of the inner container to the draining socket arranged at a front wall of the inner container and adapted for connection to the removal fitting, wherein the skid pallet of the underframe is constructed as a composite pallet, the composite pallet having the bottom of pallet and the skids made from different materials, the bottom of the pallet being flat and made of wood boards, the center skid and the two outer skids being of plastic material each of the skids having a front support leg, a center support leg, and a rear support leg, wherein the flat bottom of the pallet has above the center skid a central longitudinal opening for receiving the discharge groove of the bottom of the inner container.

2. The container according to claim 1, wherein the flat bottom is constructed of transverse boards and longitudinal boards, wherein the transverse boards are mounted at the undersides of the longitudinal boards.

3. The container according to claim 2, comprising a rear transverse board which with two end sections is placed in recesses in an upper side of the rear support legs of the two outer skids and with a middle section in an indentation in the upper side of the rear support leg of the center skid.

4. The container according to claim 2, comprising two front transverse boards which with two end sections thereof placed in indentations in an upper side of the front support leg of an outer skid each and in indentations in the upper side of the front support leg of the center skid.

5. The container according to claim 2, comprising a middle transverse board having two end sections placed on the center support legs of the two outer skids and with a middle section on a middle support leg of the center skid.

6. The container according to claim 1, wherein the flat bottom is screwed to the support legs of the center skid and the two outer skids of the pallet.

7. The container according to claim 1, comprising a screw connection of the underframe of a grate casing to the front and rear support legs of the center skid and the three support legs of each outer skid of the pallet.

* * * * *